US005273269A

United States Patent [19]

Iwanaga

[11] Patent Number: 5,273,269

[45] Date of Patent: Dec. 28, 1993

[54] SHEET FEEDING APPARATUS

[75] Inventor: Yoshiharu Iwanaga, Tokyo, Japan

[73] Assignee: Canon Kabushiki Kaisha, Tokyo, Japan

[21] Appl. No.: 726,954

[22] Filed: Jul. 8, 1991

[30] Foreign Application Priority Data

| | | | |
|---|---|---|---|
| Jul. 6, 1990 | [JP] | Japan | 2-180265 |
| Jul. 6, 1990 | [JP] | Japan | 2-180266 |
| Jul. 6, 1990 | [JP] | Japan | 2-180267 |
| Jul. 6, 1990 | [JP] | Japan | 2-180268 |
| Jul. 6, 1990 | [JP] | Japan | 2-180269 |

[51] Int. Cl.[5] ..... B65H 3/52

[52] U.S. Cl. ..... 271/124; 271/125

[58] Field of Search ..... 271/121, 124, 125, 137, 271/138

[56] References Cited

U.S. PATENT DOCUMENTS

| | | | |
|---|---|---|---|
| 2,343,479 | 3/1944 | Ryan et al. | 271/124 |
| 4,313,598 | 2/1982 | DiBlasio | 271/124 |
| 4,475,732 | 10/1984 | Clausing et al. | 271/125 |
| 4,605,217 | 8/1986 | Goi | 271/124 |
| 4,728,095 | 3/1988 | Irvine et al. | 271/124 |
| 4,858,907 | 8/1989 | Eisner et al. . | |
| 4,861,013 | 8/1989 | Shibata et al. . | |
| 4,925,177 | 5/1990 | Nakamura et al. | 271/110 |
| 4,978,115 | 12/1990 | Sato et al. | 271/124 |
| 5,029,839 | 7/1991 | Kajiwara et al. | 271/124 |
| 5,102,115 | 4/1992 | Takamizawa et al. | 271/124 |
| 5,163,669 | 11/1992 | Hurd et al. | 271/125 |
| 5,172,900 | 12/1992 | Uno et al. | 271/125 |

FOREIGN PATENT DOCUMENTS

| | | | |
|---|---|---|---|
| 0279402 | 8/1988 | European Pat. Off. . | |
| 374826 | 6/1990 | European Pat. Off. | 271/121 |
| 3347178 | 7/1984 | Fed. Rep. of Germany . | |
| 17736 | 1/1989 | Japan | 271/121 |
| 23125 | 1/1990 | Japan | 271/121 |
| 62335 | 3/1990 | Japan | 271/121 |
| 106536 | 4/1990 | Japan | 271/124 |
| 8501037 | 3/1985 | PCT Int'l Appl. . | |

*Primary Examiner*—Robert P. Olszewski
*Assistant Examiner*—Steven M. Reiss
*Attorney, Agent, or Firm*—Fitzpatrick, Cella, Harper & Scinto

[57] ABSTRACT

A sheet feeding apparatus having a sheet supporting tray for supporting sheets, a sheet supply roller for feeding out the sheet supported by the sheet supporting tray thereon, a separating device having a plurality of separating surfaces of different coefficients of friction and adapted to separate the sheets one by one by cooperating with the sheet supply and roller by abutting against the sheet supply roller, a separating surface changing device for changing the separating surface to be abutted against the sheet supply tray, a detector for detecting a poor separating condition in which the sheets are not readily separated one by one by the separating tray, and a controller for controlling the separating surface changing device in accordance with the detected result of the detector to change the separating surface to be abutted against the sheet supply tray.

31 Claims, 14 Drawing Sheets

FIG. 6A
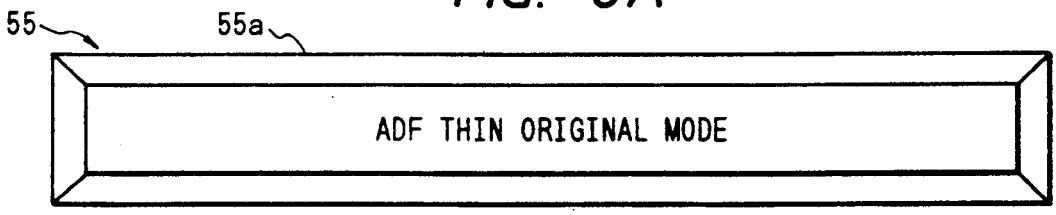
FIG. 6B
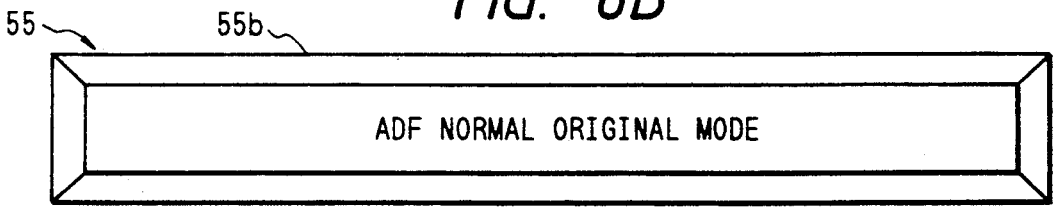
FIG. 6C
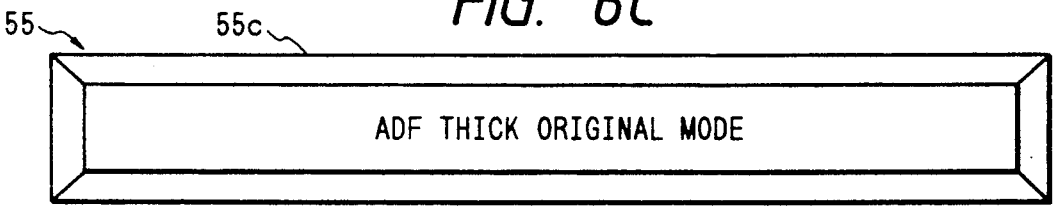
FIG. 6D1
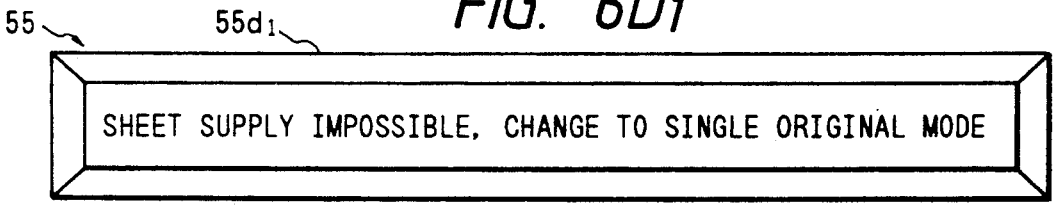
FIG. 6D
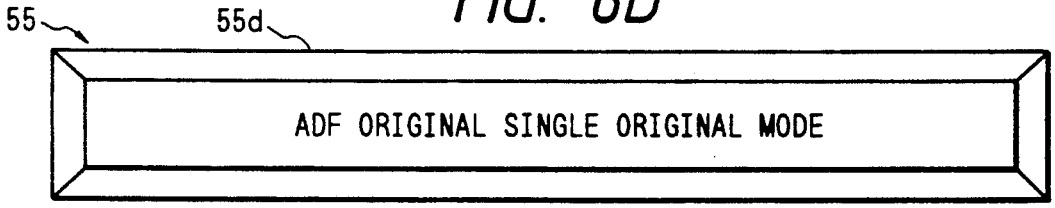

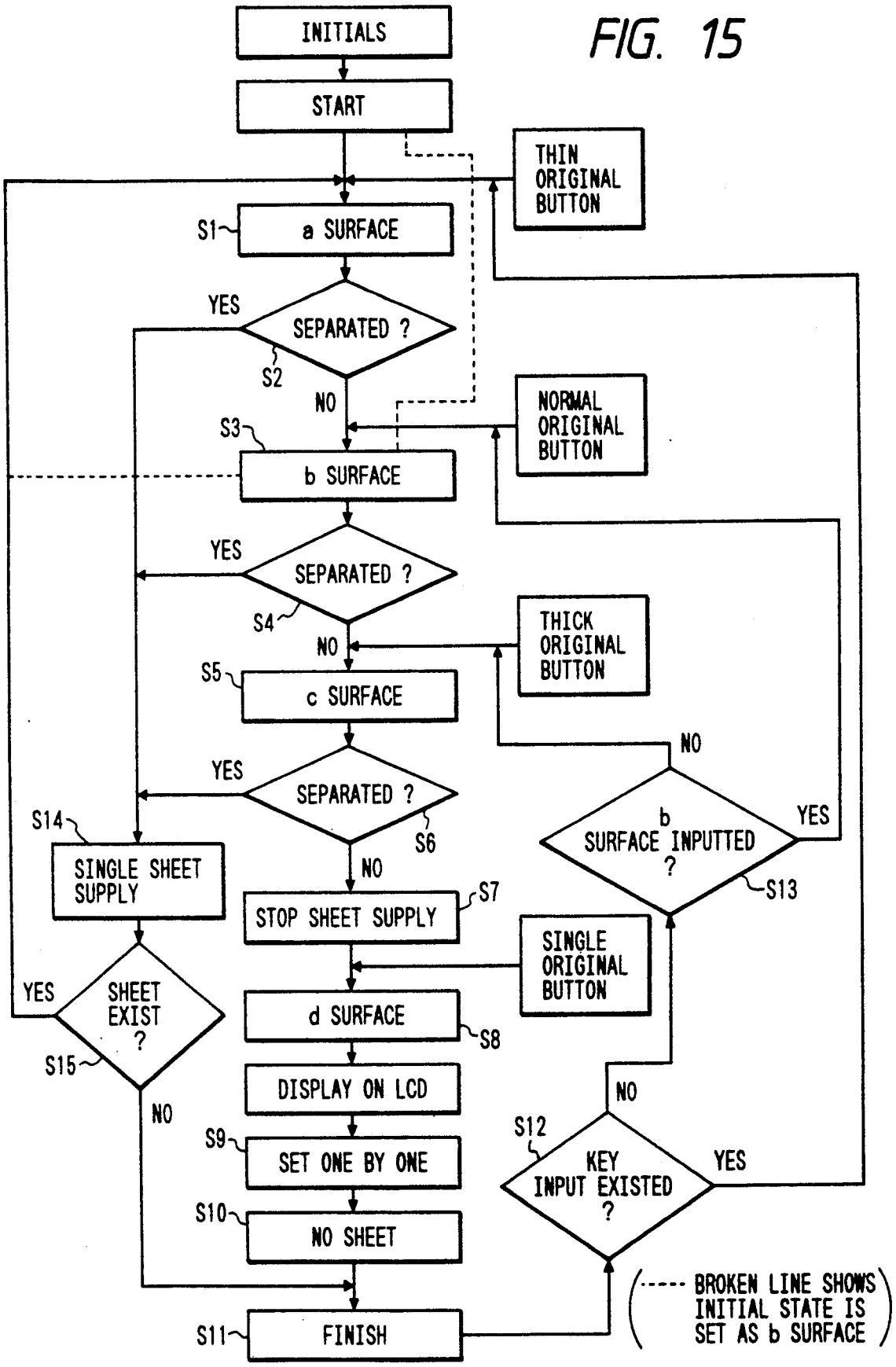
FIG. 15
INITIALS
START
THIN ORIGINAL BUTTON
S1
a SURFACE
YES
SEPARATED ?
S2
NO
NORMAL ORIGINAL BUTTON
S3
b SURFACE
YES
SEPARATED ?
S4
NO
THICK ORIGINAL BUTTON
S5
c SURFACE
NO
YES
SEPARATED ?
S6
b SURFACE INPUTTED ?
YES
S13
S14
SINGLE SHEET SUPPLY
NO
STOP SHEET SUPPLY
S7
SINGLE ORIGINAL BUTTON
YES
SHEET EXIST ?
S15
d SURFACE
S8
DISPLAY ON LCD
NO
S9
SET ONE BY ONE
S12
KEY INPUT EXISTED ?
YES
S10
NO SHEET
S11
FINISH
BROKEN LINE SHOWS INITIAL STATE IS SET AS b SURFACE

SHEET FEEDING APPARATUS

BACKGROUND OF THE INVENTION

1. Field of the Invention

The present invention relates to a sheet feeding apparatus which can separate and feed sheets by the use of the difference in coefficient of friction between a sheet supplying member for feeding the sheet and a separating member urged against the sheet supplying member with a predetermined separating pressure, and more particularly, it relates to a sheet feeding apparatus including a separating member having at least two separating surfaces of different coefficients of friction.

2. Related Background Art

An example of a conventional sheet feeding apparatus of such frictional separating type is shown in FIG. 18.

In FIG. 18, at a downstream side of a sheet stacking support (original support) 110 on which a plurality of originals (sheets) P are stacked, an elliptical calling roller 112 is fixedly mounted on a support shaft 111. A largest diameter portion of the calling roller 112 protrudes from a lower guide plate 13. A sheet holder 117 pivotally mounted at its base on an upper guide plate 116 via a shaft 115 is urged against the calling roller 112, and a compression spring 119 for biasing the sheet holder 117 toward the calling roller 112 is disposed between the sheet holder 117 and the upper guide plate 116.

At a downstream side of the calling roller 112, there is disposed a sheet supply roller 102 fixed to a support shaft 103 and rotated in a direction shown by the arrow 105 by means of a drive source (not shown) to feed the original P. A pair of feed rollers 120 comprising a driving roller 120*a* and a driven roller 120*b* which are rotated in directions shown by the arrows are arranged at a downstream side of the sheet supply roller 102. A base portion of a separating pad 121, a free end of which is abutted against the sheet supply roller 102, and a base portion of a leaf spring 131 disposed below the separating pad, are fixedly mounted on a support member 123 attached to a body cover 122. A free end of an urging plate 126 pivotally mounted at its base on the support plate 123 via a support shaft 125 is abutted against the separating pad 121, and the urging plate 126 urges the separating pad 121 against the sheet supply roller 102 under a spring force of a compression spring 129 disposed between a fixed member 127 attached to the body cover 122 and the urging plate 126.

In this arrangement, it is selected so that the coefficient of friction of the sheet supply roller 102 regarding the original P becomes greater than the coefficient of friction between the originals P and that the coefficient of friction of the separating pad 121 regarding the sheet supply roller 102 becomes smaller than the coefficient of friction between the originals P. In a condition that a plurality of originals P are stacked on the sheet stacking support 110, when the calling roller 112, sheet supply roller 102 and paired feed rollers 120 are rotated, respectively, almost all of the originals P are regulated by the sheet holder 117 so that several lower originals P are fed to the sheet supply roller 102. The fed originals P are separated and fed one by one due to the difference in the coefficient of friction between the sheet supply roller 102 and the separating pad 121. Then, the separated original is fed toward a direction shown by the arrow 130 by means of the paired feed rollers 120.

However, in the above-mentioned conventional sheet feeding apparatus 101, since the separating pad 121 for separating the originals P is made of material having the given coefficient of friction selected from the test data and the like, only either a thick sheet or a thin sheet can be exclusively handled because of the difficulty of the passing of the other sheet through the separating pad. Further, the kind of sheets to be handled was limited, and thus, there were many sheets which could not be handled by the sheet feeding apparatus.

Particularly, when the sheet feeding apparatus 101 was used as an original feeding apparatus, since there was no separating pad 121 capable of handling all kinds of originals, it took a long time and much labor for testing and selecting the coefficient of friction of the separating pad 121. Further, the sheet supply ability of the sheet feeding apparatus was greatly influenced upon even the difference in the circumstance where the sheet feeding apparatus was used, and, therefore, the conventional sheet feeding apparatus could not satisfy all of the requirements.

SUMMARY OF THE INVENTION

An object of the present invention is to provide a sheet feeding apparatus which can surely supply a sheet even in the case of sheets having various different thickness and/or even under the different service circumstances.

In order to achieve the above object, the present invention provides a sheet feeding apparatus comprising a sheet supporting means for supporting sheets, a sheet supply means for feeding out the sheet supported by the sheet supporting means, a separating means having a plurality of separating surfaces of different coefficients of friction and adapted to separate the sheets between the separating means and the sheet supply means by abutting against the sheet supply means, a separating surface changing means for changing the separating surface to be abutted against the sheet supply means, a detection means for detecting a separating condition established by the separating means, and a control means for controlling the separating surface changing means in accordance with the separating condition detected by the detection means to change the separating surface to be abutted against the sheet supply means.

If a poor separating condition is detected by the detection means, by changing the separating surface from the present separating surface to a new separating surface having the coefficient of friction capable of separating the present sheets, the sheet can be surely separated and supplied.

Further, the present invention provides a sheet feeding apparatus comprising a sheet supporting means for supporting sheets, a sheet supply means for feeding out the sheet supported by the sheet supporting means, a separating means having a plurality of separating surfaces of different coefficients of friction and adapted to separate the sheets between the separating means and the sheet supply means by abutting against the sheet supply means, a separating surface changing means for changing the separating surface to be abutted against the sheet supply means, and a separating pressure changing means for changing a separating pressure between the sheet supply means and the separating means.

By changing the separating pressure to an appropriate value in accordance with the coefficient of friction changed in the changing (altering) of the separating surfaces, an optimum separating condition can be obtained in accordance with a thickness of the sheet to be supplied, thereby surely separating and feeding the sheet.

Furthermore, the present invention provides a sheet feeding apparatus comprising a sheet supporting means for supporting sheets, a sheet supply means for feeding out the sheet supported by the sheet supporting means, a separating means having a plurality of separating surfaces of different coefficients of friction and adapted to separate the sheets between the separating means and the sheet supply means by abutting against the sheet supply means, a separating surface changing means for changing the separating surface to be abutted against the sheet supply means, and a separating pressure releasing means for releasing a separating pressure between the sheet supply means and the separating means.

By releasing the separating pressure in the changing of the separating surfaces, the separating surface can easily be changed. Further, in the changing of the separating surfaces, it is possible to prevent the wear of the sheet supply means due to the contact between the sheet supply means and the separating surface having the higher coefficient of friction.

BRIEF DESCRIPTION OF THE DRAWINGS

FIGS. 6A to 6D are plan views of the display portion during a keyboard operation;

FIG. 15 is a flow chart executed when various kinds of sheets are stacked;

DETAILED DESCRIPTION OF THE PREFERRED EMBODIMENTS

The present invention will now be explained in connection with an embodiment thereof embodied as a sheet feeding apparatus acting as an automatic document feeder (referred to as "ADF" hereinafter) with reference to the accompnaying drawings.

Figure 1:
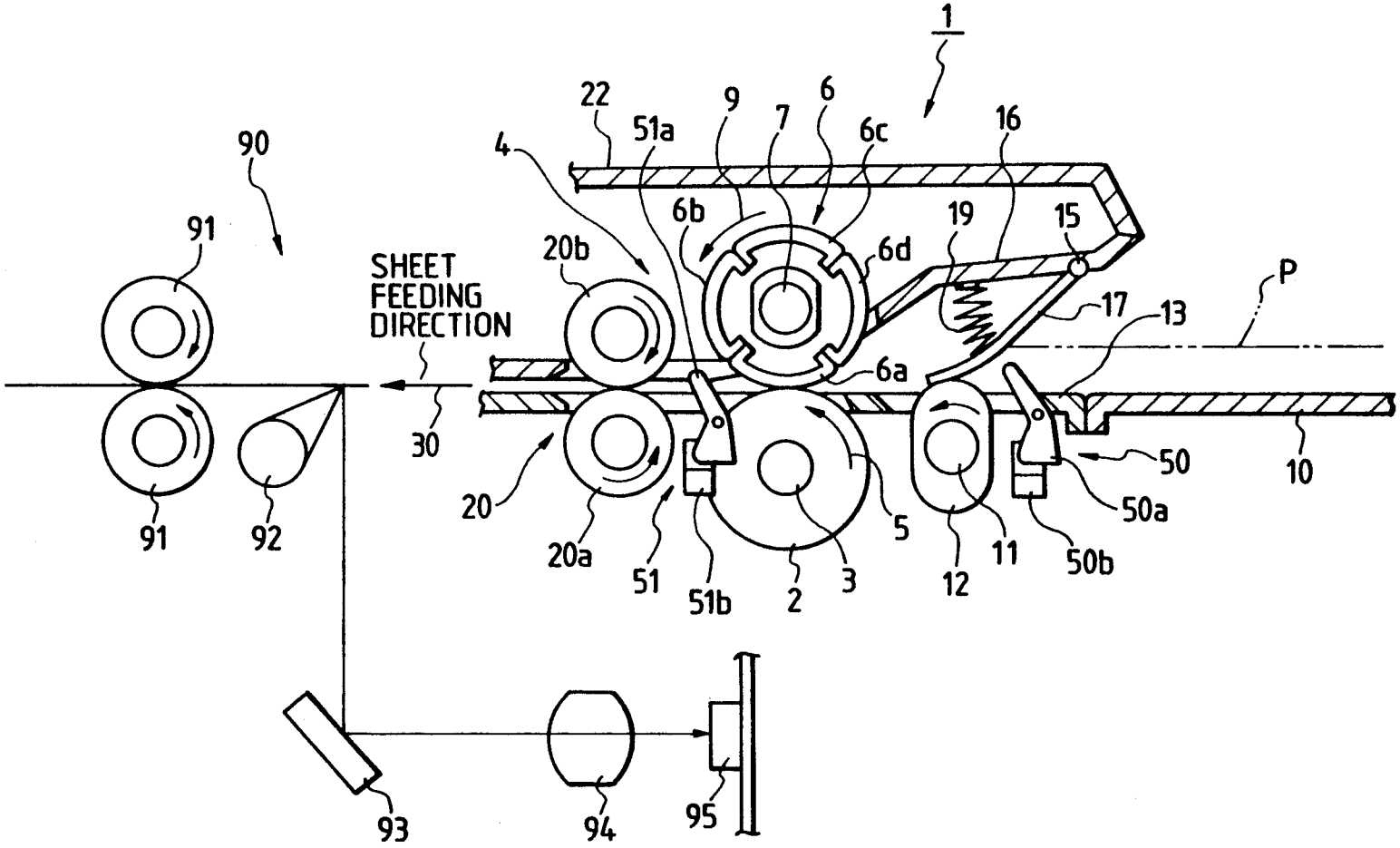
FIG. 1 is an elevational sectional view of a sheet feeding apparatus to which the present invention is applied.
Figure 2:
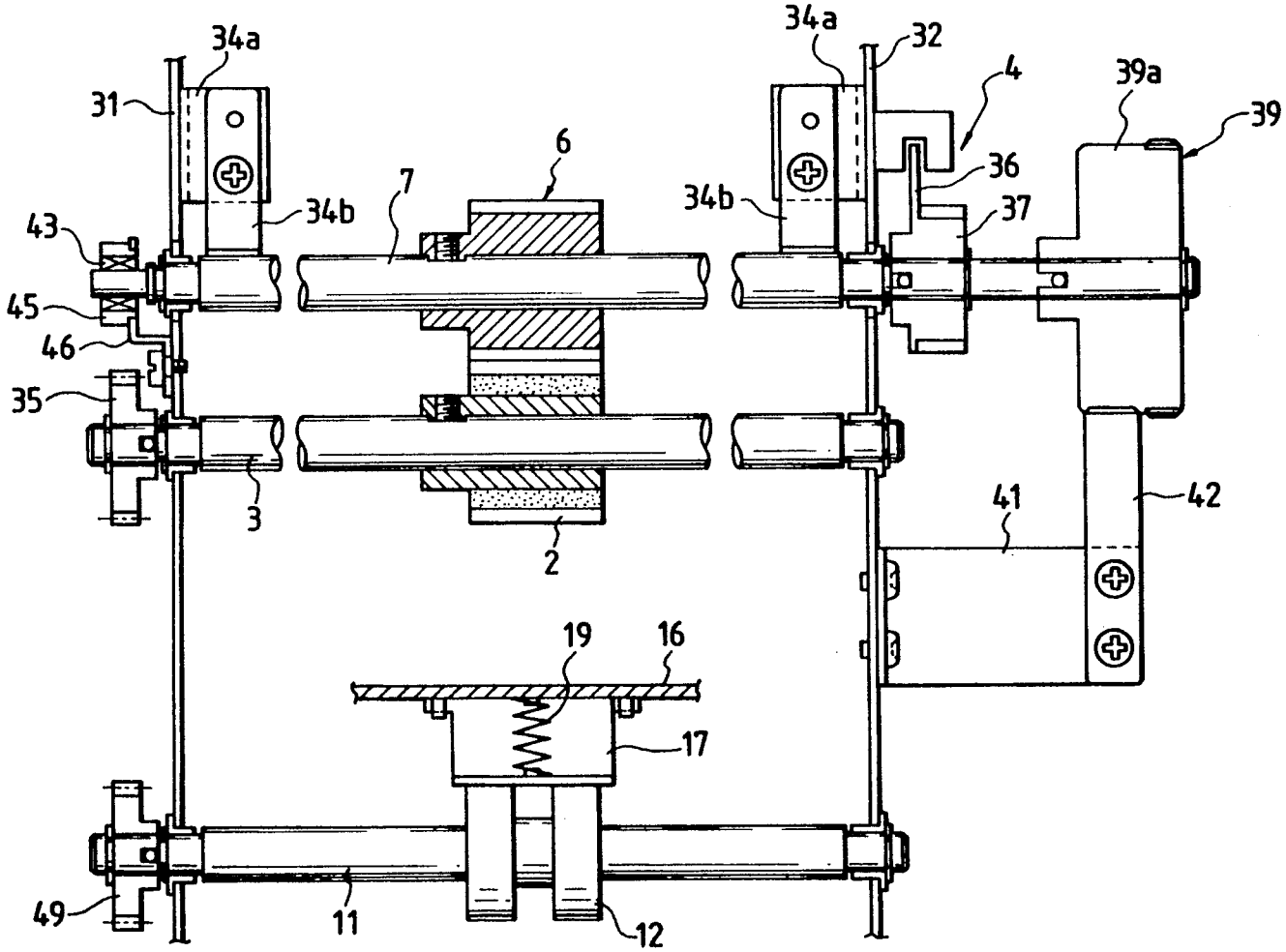
FIG. 2 is a development plan view of the sheet feeding apparatus of FIG. 1.

FIGS. 1 and 2 show an apparatus (ADF) 1 for feeding an original P as a sheet.

In FIGS. 1 and 2, as shown in FIG. 2, a support shaft 3 on which a sheet supply roller (sheet supplying member) 2 is fixedly mounted is rotatably supported by a pair of side plates 31, 32 via bearings. A gear 35 is fixed to a protruded end of the support shaft 3 is connected to a sheet feed motor 33 (FIG. 13) acting as a driving source.

Figure 3A:
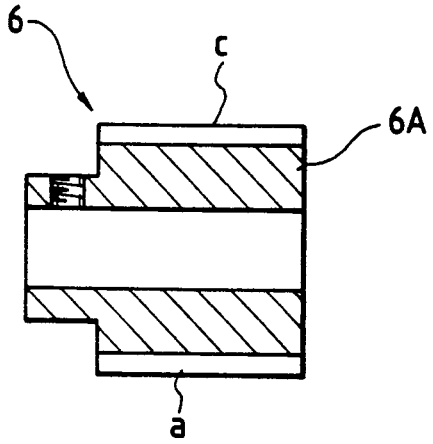
FIG. 3A is a sectional view of a separating member.
Figure 3B:
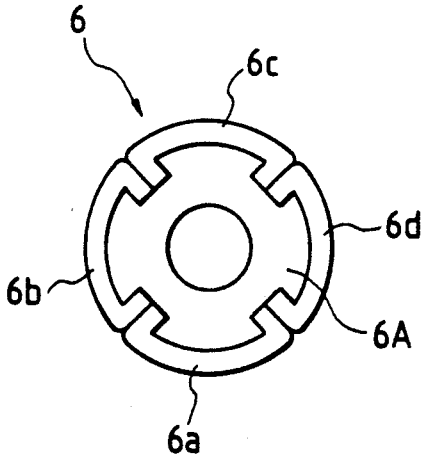
FIG. 3B is an end view of the separating member.

A separating member 6 fixed to a separating roller shaft 7 is urged against the sheet supply roller 2 as will be described later, and the separating roller shaft 7 is rotatably received in slots formed in the side plates 31, 32 via respective bearings. As shown in FIGS. 3A and 3B, the separating member 6 includes at least two (four in the illustrated embodiment) separating surfaces **6*a*–6*d* having different coefficients of friction and fixedly mounted on a peripheral surface of a base roller 6A. A pair of leaf springs 34*b* for urging the separating roller shaft 7 are attached to a pair of support members 34*a* fixed to the side plates 31, 32, respectively, so that a separating pressure of the separating member 6 regarding the sheet supply roller 2 can be obtained by spring forces of the leaf springs 34*b***.

The coefficients of friction of the separating surface **6*a*–6*d* are selected to have a relation $\mu a > \mu b > \mu c > \mu d$. Particularly, the coefficient of friction $\mu d$ of the separating surface 6*d* is selected to have a lower value satisfying a relation $\mu d \leqq \mu p$ with respect to the coefficient of friction $\mu p$ between the originals P. To obtain the separating surface 6*d* having such lower coefficient of friction, for example, material such as Mylar TM may be used. The separating surface 6*d*** cannot separate the double-fed originals from each other, but can particularly be used when the original P is supplied manually one by one.

Further, when the coefficient of friction of the sheet supply roller 2 regarding the original P is $\mu_1$, it is selected to have relations $\mu_1 > \mu a$ and $\mu c > \mu p$ (coefficient of friction between the originals). The separating member 6 is rotated by means of a command means (described later) so that one of the separating surfaces **6*a*–6*d* having a predetermined coefficient of friction are urged against the sheet supply roller 2**.

A gear 37 formed integrally with a position detection plate 36 and a manually operating knob (command means) 39 for rotating the separating member 6 in a manner as described later are fixedly mounted on an end (right end in FIG. 2) of the separating roller shaft 7 which extends from the side plate 32. As shown in FIGS. 5A to 5D, informations corresponding to the coefficients of friction of the separating surfaces **6*a*–6*d* of the separating member 6** urged against the sheet supply roller 2 are marked on an peripheral surface 39*a* of the knob 39.

That is to say, characters 40*a*–40*d*, each representing the kind of the original P to be separated by the selected separating surfaces 6*a*–6*d*, are displayed on a display portion 40. The characters 40*a*–40*d* correspond to the separating surfaces 6*a*–6*d* of the separating member 6, respectively. For example, when the originals P comprising normal sheets are supplied, the corresponding separating surface 6*b* is urged against the sheet supply roller 2 in a manner which will be described later and the character 40*b* is displayed on the display portion 40.

Figure 4A:
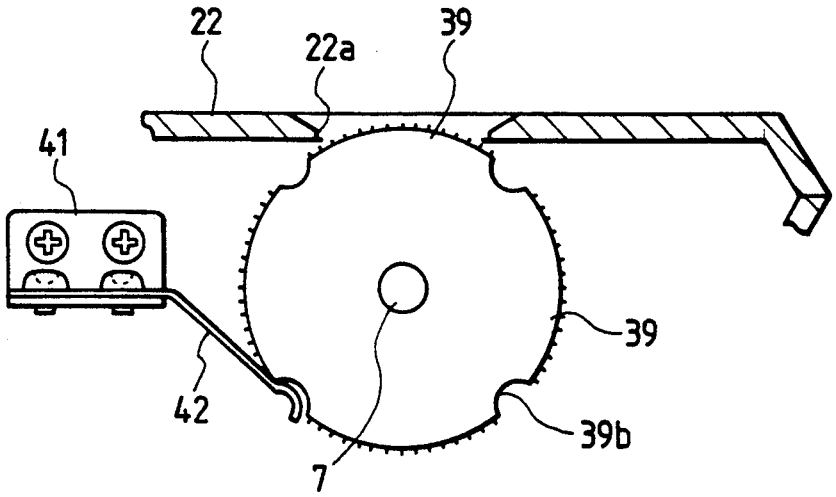
FIG. 4A is an elevational sectional view of a manual operating knob portion.
Figure 4B:
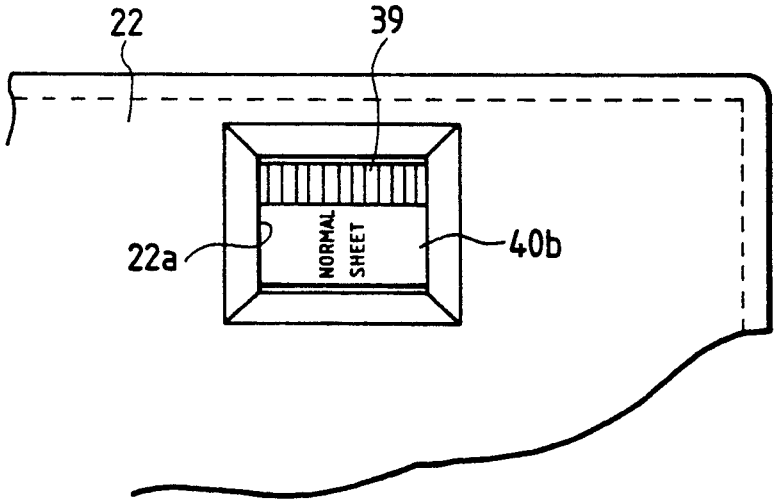
FIG. 4B is a plan view of the knob portion.
Figure 5A:
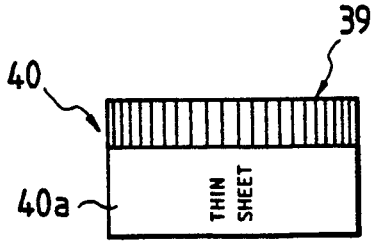
FIGS. 5A to 5D are plan views showing a display portion.
Figure 5B:
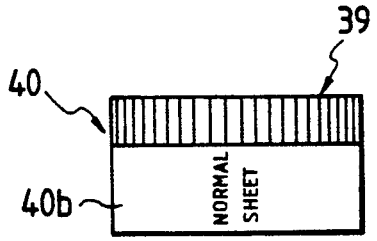
Figure 5C:
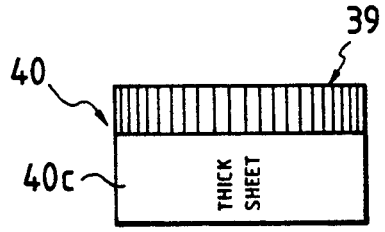
Figure 5D:
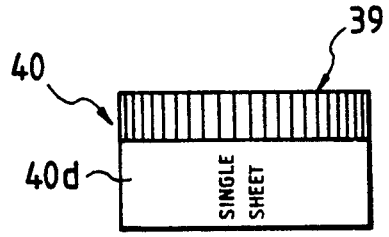

As shown in FIGS. 4A and 4B, the knob 39 can be rotated by manually manipulating it from outside of a window 22*a* formed in the body cover 22, the character 40*a*–40*d* set by the knob 39 can be seen through the display portion 40. Further, as shown in FIG. 4A, a plurality of click recesses 39*b* are formed on the peripheral surface 39*a* of the knob 39. By engaging a free end of a leaf spring 42 attached at its base to the body cover 22 via an attachment member 41 with one of the click recesses, the selected position of the knob 39 is maintained.

Figure 3C:
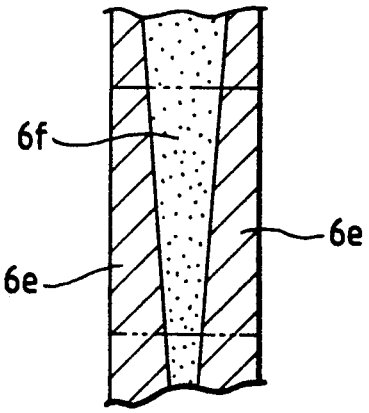
FIG. 3C is a development view of a separating surface of a separating member according to another embodiment.

An opposite protruded end of the separating roller shaft 7 is mounted in a bearing 45 via a one-way clutch 43, which bearing 45 is mounted on a support member 46 fixed to the side plate 31 for up-and-down movement within a predetermined range. By the action of the one-way clutch 43, the separating member 6 can be rotated only in a direction shown by the arrow 9 in FIG. 1 and cannot be rotated in an opposite direction. Incidentally, the separating surfaces 6*a*, 6*b*, 6*c* and 6*d* are so arranged that, as the separating member 6 is rotated in the direction shown by the arrow 9, the separating surfaces 6*a* having the greatest coefficient of friction), 6*b*, 6*c* and 6*d* (having the smallest coefficient of friction) are sequentially urged against the sheet supply roller 2. Incidentally, in order to change the coefficients of friction of the separating surfaces 6*a*, 6*b*, 6*c*, 6*d*, in place of the above-mentioned arrangement, as shown in FIG. 3C, a surface 6*f* having the higher coefficient of friction and a surface 6*e* having a lower coefficient of friction may be formed on the peripheral surface of the base roller 6A along the circumferential direction thereof and a width of the surface 6*f* having the higher coefficient of friction may be proportionally increased along the circumferential direction of the base roller.

Figure 13:
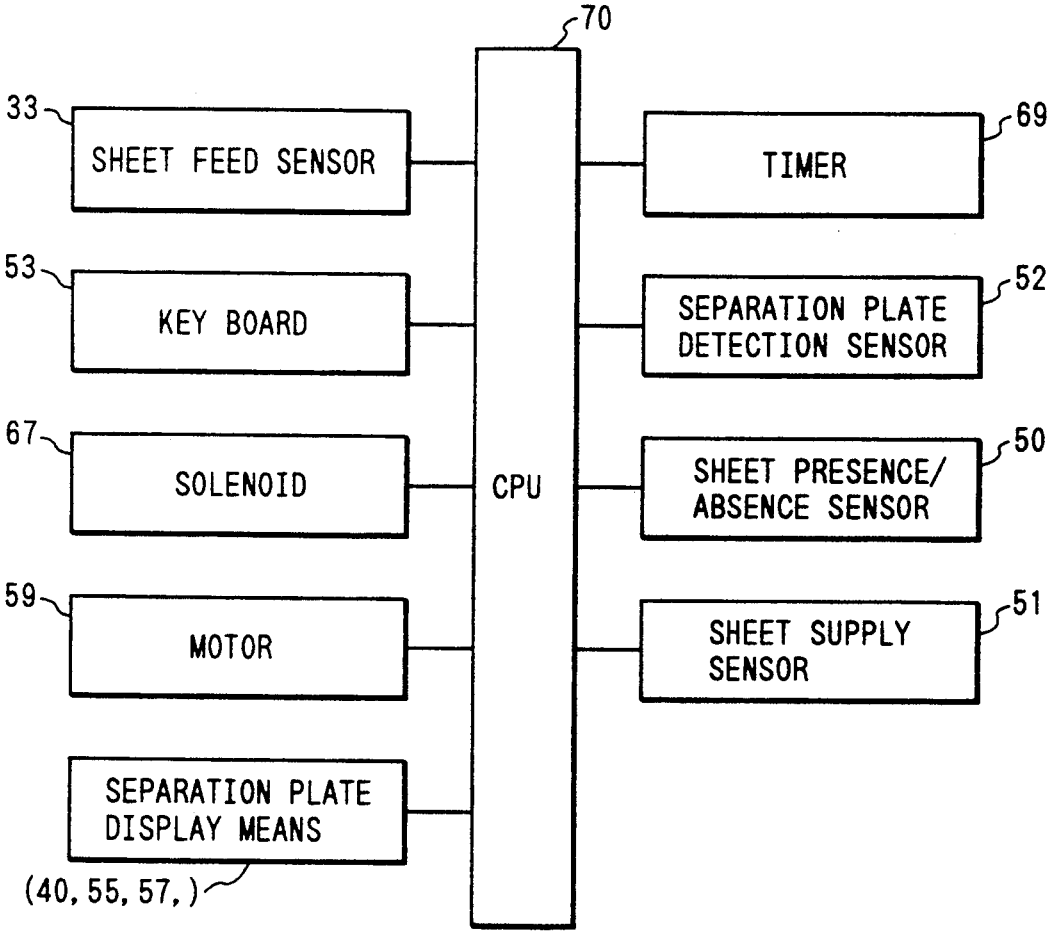
FIG. 13 is a block diagram of a controlling portion associated with the present invention.

As shown in FIG. 2, a gear 49 is fixedly mounted on one end of a support shaft 11 to which the calling roller 12 is fixed. The gear 49 is connected to the sheet feed motor 33 (FIG. 13). As shown in FIG. 1, a sheet presence/absence sensor 50 for detecting the presence/absence of the original P on the sheet stacking support 10 is disposed at an upstream side of the calling roller 12, which sensor 50 comprises a sensor lever 50*a* rotated by the original P and a photo-interrupter 50*b* turned ON/-OFF by the sensor lever. Incidentally, as in the conventional case, the largest diameter portion of the calling roller 12 protrudes from a lower guide plate 13, and a sheet holder 17 pivotally mounted at its base on an upper guide plate 16 via a shaft 15 is urged against the largest diameter portion of the calling roller under a biasing force of a compression spring 19.

Further, at a downstream side of the sheet supply roller 2, there is disposed a sheet supply sensor 51 comprising a sensor lever 51*a* and a photointerrupter 51*b*. The sheet supply sensor 51 serves to detect the original P supplied by the sheet supply roller 2 and to detect whether the original P is properly separated by the separating surface 6*a*, 6*b*, 6*c* or 6*d* which is now urged against the sheet supply roller, i.e., whether the separating surface now urged against the sheet supply roller is suited to the original P to be supplied. Incidentally, the detection method will be described later.

A feed roller 20 comprising a drive roller 20*a* and a driven roller 20*b* is disposed at a downstream side of the sheet supply sensor 51.

Figure 7:
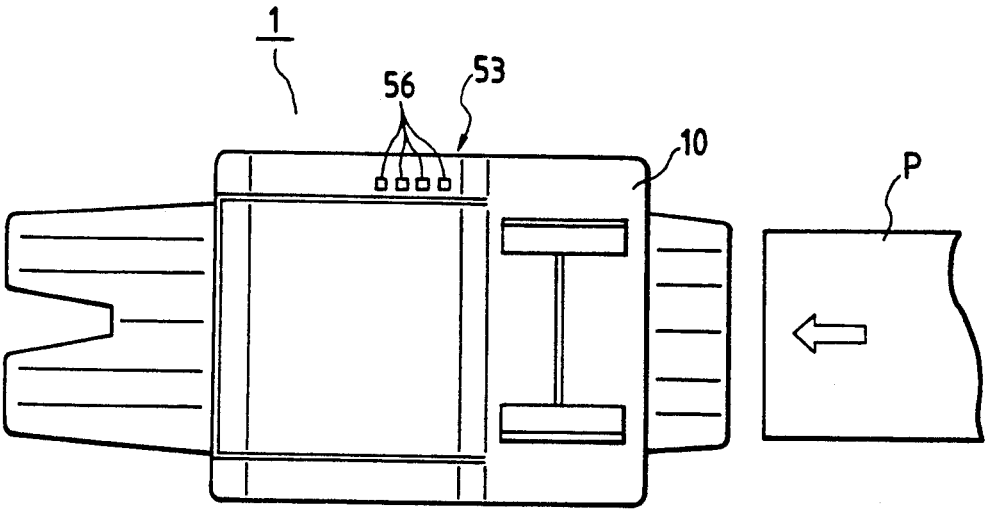
FIG. 7 is a plan view of an image forming system and a keyboard thereof to which the present invention is applied.
Figure 8:
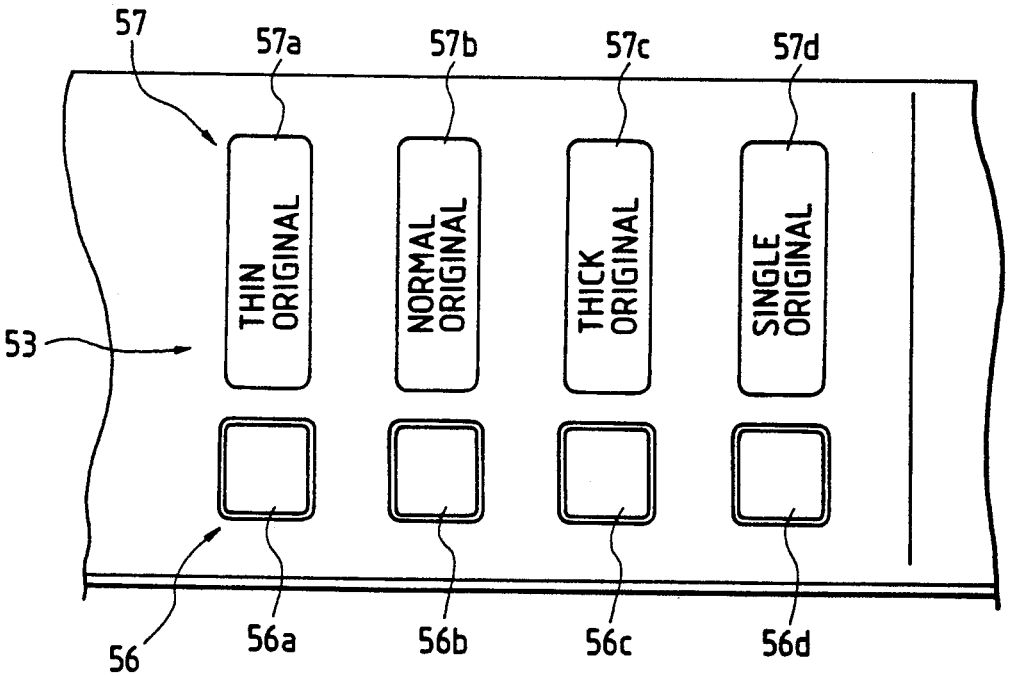
FIG. 8 is an enlarged plan view of the keyboard.

As mentioned above, while one of the separating surfaces 6*a*–6*d* can be urged against the sheet supply roller 2 by manually manipulating the knob 39, this urging operation may be effected by a keyboard shown in FIGS. 7 and 8. In FIGS. 7 and 8, at one side of the printer (image forming system) into which the ADF (automatic document feeder) as the sheet feeding apparatus is incorporated, there is disposed a keyboard 53 for setting the separating surface 6*a*–6*d* to be used. As shown in FIG. 8, the keyboard 53 includes operation buttons 56 (56*a*–56*d*) corresponding to the separating surfaces 6*a*–6*d*, respectively, and a display portion 57 for displaying the contents of the pushed button by a character 57*a*–57*d*.

The display in the display portion 57 may be effected by illuminating the pushed (or set) button or may be effected by lighting the corresponding character 57*a*, 57*b*, 57*c* or 57*d* by illuminating the character from underside. Alternatively, when the operation buttons 56 are manipulated, as shown in FIGS. 6A to 6D, the conditions of the separating surfaces 6*a*–6*d* may be displayed by utilizing LCD display portions 55.

Figure 9A:
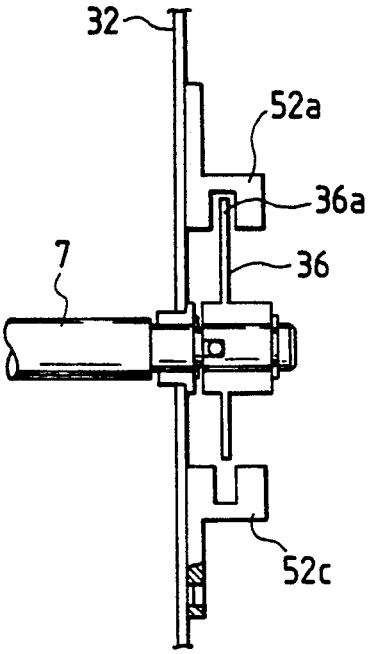
FIG. 9A is an elevational sectional view of a position detection plate.
Figure 9B:
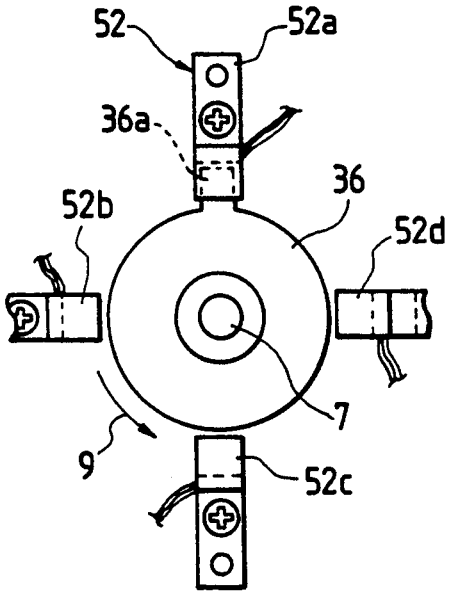
FIG. 9B is an end view of the position detection plate.
Figure 9C:
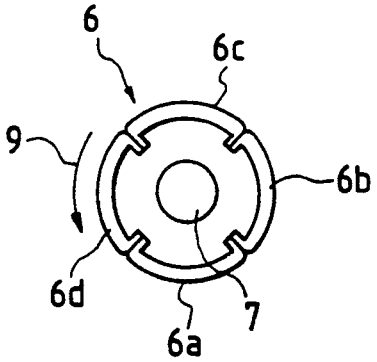
FIG. 9C is a view showing a positional relation between a separating surface detection sensor and a separating member.

When the separating surface is set by the keyboard 53, it is necessary to provide a driving force for driving the separating member 6 in response to the operation button 56 pushed, and this driving force is obtained by transmitting a rotation of a motor 59 (FIG. 13) to a gear 37 (FIG. 2) integral with the separating member 6. Further, in order to detect the separating surface 6*a*, 6*b*, 6*c* or 6*d* which are now urged against the sheet supply roller 2, as shown in FIG. 9B, a plurality of separating surface detection sensors 52 (52*a*–52*d*) are disposed at predetermined positions, these detection sensors being detected by a flag 36*a* formed on the position detection plate 36. The positions of the separating surface detection sensors 52*a*–52*d* correspond to the positions of the separating surfaces 6*a*–6*d*, as shown in FIGS. 9B and 9C.

Figure 11A:
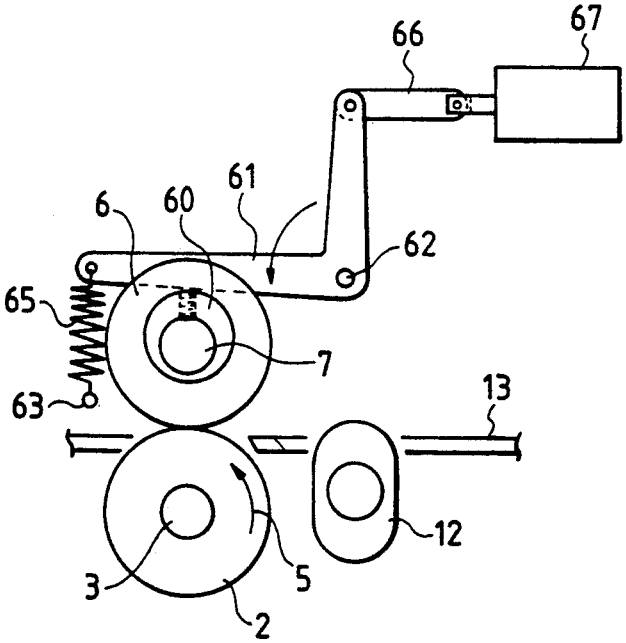
FIG. 11A is an elevational sectional view of a separating pressure releasing mechanism.
Figure 11B:
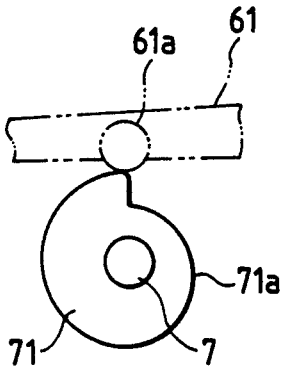
FIG. 11B is a side view showing another embodiment of a separating pressure releasing mechanism.

FIGS. 11A and 11B show a mechanism for varying the separating pressure of the separating member 6.

In FIG. 11A, an eccentric cam 60 is fixedly mounted on the separating roller shaft 7 integral with the separating member 6, and a pressure member 61 is urged against an upper portion of the eccentric cam 60 by a spring force of a tension spring 65 one end of which is connected to a pin 63. The pressure member 61 is pivotally mounted on a support shaft 62 and an upper end of the pressure member is connected to a solenoid 67 via a connection member 66. When the solenoid 67 is in an OFF condition, the separating member 6 is urged against the sheet supply roller with the separating pressure obtained by the spring force of the tension spring 65. When the separating surfaces 6*a*–6*d* are changed by the rotation of the separating member 6 as will be described later, the separating pressure regarding the sheet supply roller 2 is also varied by the action of the eccentric cam 60.

When the separating surfaces 6*a*–6*d* of the separating member 6 are changed, since the separating pressure acts on both the separating member 6 and the sheet supply roller 2, on changing the separating surfaces 6a–6d, the solenoid 67 is turned ON so that the load on the drive means such as the motor is reduced, thus releasing the separating pressure to facilitate the rotation of the separating member 6.

Alternatively, as shown in FIG. 11B, it is possible to vary the separating pressure by providing an Archimedean cam 71 and by urging a roller 61a mounted on the pressure member 61 against the cam 71. As the Archimedean cam 71 is rotated along with the separating member 6, the spring force of the tension spring 65 is changed, with the result that the separating pressure of the separating member 6 is varied in response to the variation of the rotational position of the separating member 6, i.e., the change-over of the separating surfaces to be urged against the sheet supply roller.

Incidentally, by combining the separating member 6 continuously changing the coefficient of friction of the separating surfaces as shown in FIG. 3C with the Archimedean cam 71, the change-over of the separating surfaces and the variation of the separating pressure can be continuously effected.

The above-mentioned position detection plate 36, one-way clutch 43, sheet supply sensor 51, separating surface detection sensors 52, timer 69 and CPU 70 (FIG. 13) constitute a separating member changing means for changing the separating surfaces 6a–6d of the separating member 6 to a selected one by the command means 4.

Figure 14:
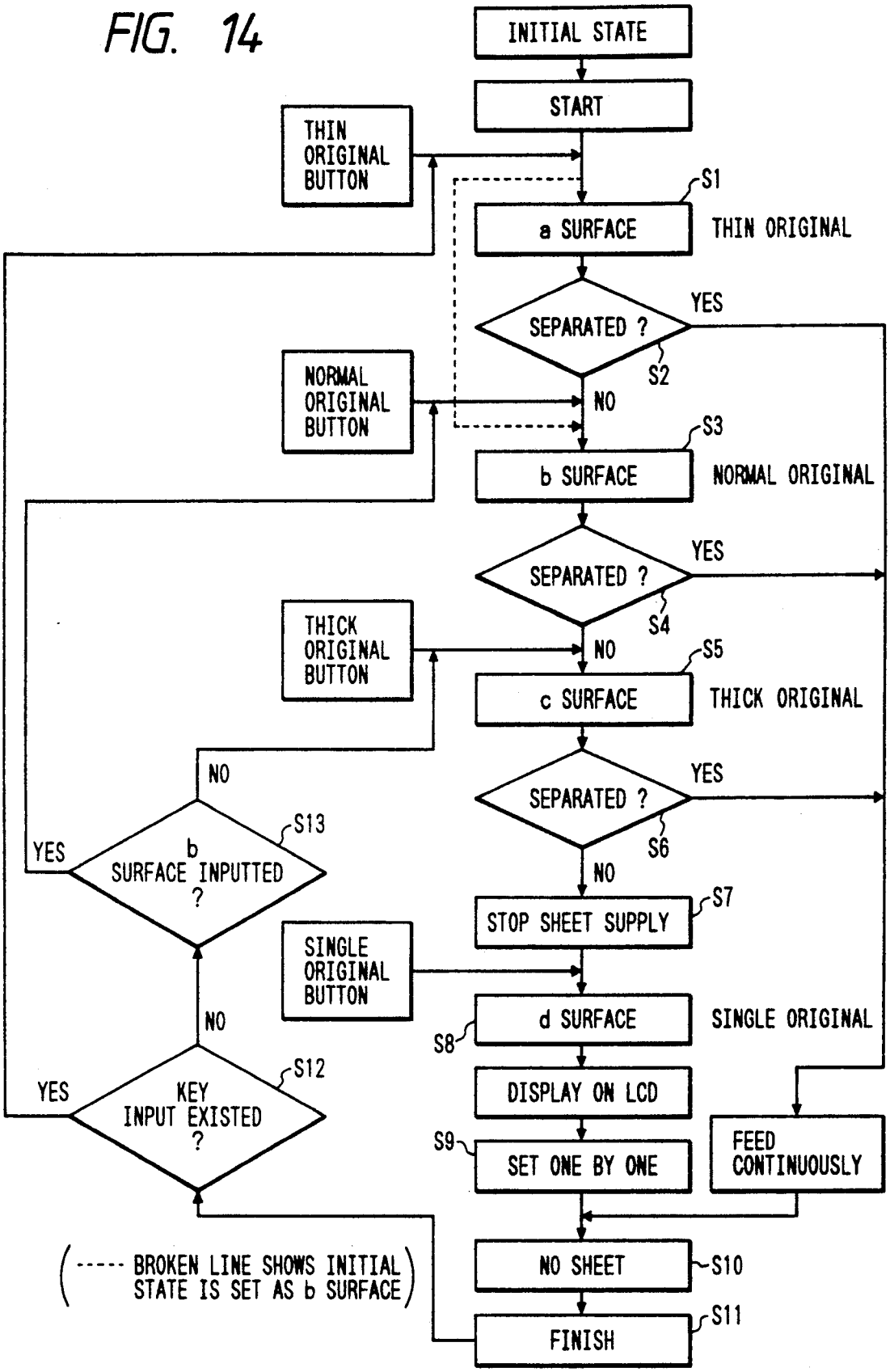
FIG. 14 is a flow chart executed when the same kind of sheets are stacked.

Next, the operation of the automatic document feeder having the above-mentioned construction will be explained with reference to the aforementioned Figures and flow charts shown in FIGS. 14 and 15. Incidentally, FIG. 14 is a flow chart executed when the same kind of originals P are stacked, and FIG. 15 is a flow chart executed when various kinds of originals P are stacked.

First of all, a same kind original mode will be explained. When a plurality of originals P are stacked on the sheet stacking support 10, these originals are detected by the sheet presence/absence sensor 50. Now, when a start key is depressed, the sheet feed motor 33 shown in FIG. 1 is rotated to rotate the calling roller 12, sheet supply roller 2 and paired feed rollers 20, thus feeding one or more originals P to the sheet supply roller 2.

Prior to the separation of the originals P, the separating surface 6a of the separating member 6 having the greatest coefficient of friction is urged against the sheet supply roller 2 (step S1), this condition being referred to as an "initial position" (home position). Among the originals P, an original P suited to be separated by the separating surface 6a having the greatest coefficient of friction is, for example, a thin original which is difficult to be separated. Then, a normal original, thick original and the like are to be separated by the separating surfaces 6b, 6c and the like.

Figure 10:
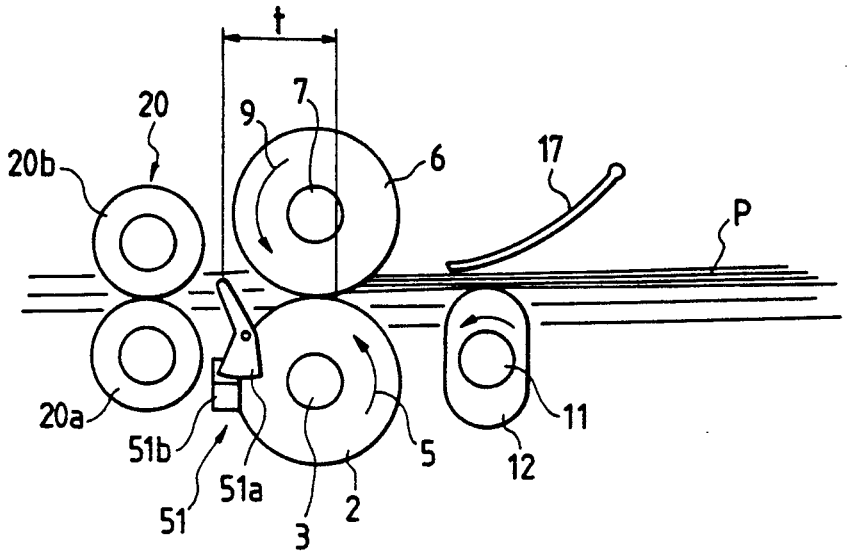
FIG. 10 is an elevational sectional view for explaining an operation of the apparatus of FIG. 1.

Referring to FIG. 10, the separating operation of the originals P will be explained. The originals P situated between the sheet supply roller 2 and the separating member 6 are separated by the sheet supply roller 2 and the separating member 6 rotated in the directions shown by the arrows 5, 9 in response to the sheet supply command emitted by the energization of the start button, with the result that the separated original is fed toward a direction shown by the arrow 30 (FIG. 1) at a speed same as a rotational speed of the sheet supply roller 2 or a slower speed if there is slip between the original and the sheet supply roller. Then, the original is detected by the sheet supply sensor 51. When the original is fed by the paired feed rollers 20, the sheet supply roller 2 is stopped.

Figure 12:
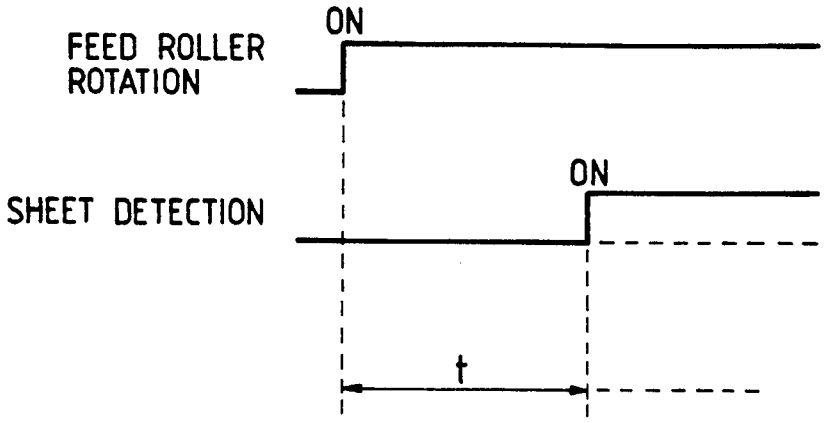
FIG. 12 is a timing chart showing a relation between the rotation of a sheet supply roller and the sheet detection after sheet supply.

Now, it is assumed that a time when the original P fed with slip advances from the contacting area between the sheet supply roller 2 and the separating member 6 to the position of the sensor lever 51a of the sheet supply sensor 51 is t (FIG. 12), it means that the original P which requires a time more than the time t is not suited to be separated by the separating surface 6a of the separating member 6 urged against the sheet supply roller 2.

In this case, the original supplying operation is stopped once, and the separating member 6 is rotated in the direction 9 by the motor 59. Then, the rotation of the separating member is stopped by the detection of the separating surface detection sensor 52 (52b). Then, the sheet supply roller 2 is rotated again to repeat the similar separating operation (with the separating surface 6b). In this way, by changing the separating surfaces 6a–6d, the original supplying operation is continued when the original can be supplied; whereas, if the original cannot be supplied, the alarm (alarming sound, alarming lamp or the like) is generated and the LCD display portion 57 is energized.

As mentioned above, by automatically changing the separating surfaces 6a–6d on the basis of a parameter of t, the sheet supplying operation can be continued. When the original supplying operation is finished, the separating member 6 must be returned to the initial position.

Explaining the above-mentioned operation with reference to FIG. 14, when separator of the original P is tried by the separating surface 6a (a surface) of the separating member 6 through the rotation of the sheet supply roller 2 (step S2), if the original can be separated, the separating operation is continued until no sheet condition (step S10) is established, and then the sheet supplying operation is stopped (step S11). On the other hand, if the original cannot be separated by the separating surface 6a in the step S2, the separating member 6 is rotated by the motor 59 to urge the separating surface 6b against the sheet supply roller 2 (step S3). This condition is detected by the separating surface detection sensor 52b shown in FIG. 9B, with the result that the separating member 6 is stopped and such condition is displayed on the display portion 57 or the display portion 55.

In a step S4, if the original P can be separated by the separating surface 6b (b surface), the separating operation is continued until no sheet condition (step S10) is established, and then the sheet supplying operation is stopped (step S11). On the other hand, if the original cannot be separated by the separating surface 6b in the step S4, the separating member 6 is rotated in the same manner as in the step S2 to urge the separating surface 6c against the sheet supply roller 2 (step S5), whereby the original P is tried to be separated by the separating surface 6c (step S6). If the original P can be separated by the separating surface 6c (c surface), the separating operation is continued until no sheet condition (step S10) is established.

On the other hand, if the original cannot be separated by the separating surface 6c in the step S6, the separating member 6 is not automatically rotated, but the sheet supplying operation is stopped (step S7). This sheet separation impossible condition is alarmed by the alarm means or displayed on the display portion 55 (FIG. 5) as the character 55d$_1$. In this condition, an operator pushes the operation button 56d (FIG. 8) for single original, thereby rotating the separating member 6 to urge the separating surface 6d (d surface) against the sheet supply roller 2 (step S8). The single original mode is displayed on the LCD as the character 55d, as shown in FIG. 6D.

The "single original mode" means a condition that a portion (separating surface 6d) of the separating member 6 is made of material having low coefficient of friction such as Teflon (Trade Mark) and the single original P can be supplied without fail. The single original mode is a mode which is to be utilized when the original P could be not separated by all of the separating surfaces 6a, 6b and 6c and which is set at the last stage in changing the separating surfaces 6a–6d. As mentioned above, the changing of the separating surfaces 6a–6d is effected by sequentially rotating the separating member from the area having the greatest coefficient of friction to the area having the smallest coefficient of friction. Thus, by automatically changing the separating surfaces, it is possible to supply any kind of originals.

In the single original mode, the originals are set one by one manually between the sheet supply roller and the separating member to supply the original (step S9). In this manual sheet supplying operation, since the coefficient $\mu d$ of friction between the separating surface 6d and the original P is selected to be smaller than the coefficient $\mu p$ of friction between the originals P, if a plurality of originals P are inserted simultaneously, the originals will be double-fed. That is to say, the separating surface 6d has a smaller coefficient of friction so as to permit the manual sheet supply, thus facilitating the supplying of original one by one.

Further, since the normal sheet is usually used as the original P, by previously setting the separating surface 6b through the knob 39 or the keyboard 53 prior to the starting of the sheet supplying operation, it is possible to shorten or save the working time due to the omission of the setting of the separating surface 6a.

Next, when the separation of the original P by means of the separating member 6 is finished (step S11), it is judged whether there is the key input from the keyboard 53 (step S12). If negative, the separating member 6 is returned to the initial position (home position) to start the separating operation from the separating surface 6a (step S1). In the step S12, if there is key input, it is judged whether the key input corresponds to the separating surface (b surface) (step S13). If the b surface, the sequence returns to the step S3 to start the separation of the original P by means of the separating surface 6b; whereas, if not the b surface, the sequence returns to the step S5 to start the separation of the original P by means of the separating surface 6b.

FIG. 15 shows the flow chart executed when various kinds of originals P are stacked (i.e., each original has a different feature). In FIG. 15, since the sequential changing of the separating surfaces 6a–6d when the original P cannot be separated at the initiation of the separating operation is the same as that in the same kind original mode shown in FIG. 14, the explanation thereof will be omitted.

The difference of the various kinds mode from the same kind mode is that, when the originals P are separated by the selected separating surface 6a, 6b, 6c or 6d, it is judged whether the original P exists or not (step S15) per each single sheet (original) supply (step S14). In the step S15, if the original P exists, the sequence always returns to the step S1, from where the separation of the original is started for each original. When there is no original to be supplied, the original supplying operation is finished in the step S11 and the separating member 6 is returned to the initial position and is stopped.

By supplying the originals P in this way, even when the various kinds of originals P are stacked on the sheet stacking support 10, since the setting of the separating member 6 of the ADF is automatically changed, the originals P having different features can be set with a safe conscience.

In the above-mentioned various kinds original P mode, it is also possible to previously set or select the initial position of the separating member 6 by previously manipulating the operation buttons 56 of the keyboard 53 shown in FIG. 8. In this case, the separating member 6 returns to the previously set initial position. Thus, on initiating the original supplying operation, it is possible to start from the normal sheet (original P) or thick sheet rather than the thin sheet, thereby omitting the former or previous step or steps, with the result that the original supplying operation can be performed effectively.

Further, the separating surfaces of the separating member 6 are changed as mentioned above due to the change in the feature of the original P, it is possible to simultaneously change or vary the separating pressure suited for the separating surface to be used, by utilizing the separating pressure changing means as explained in connection with FIG. 11.

Figure 16:
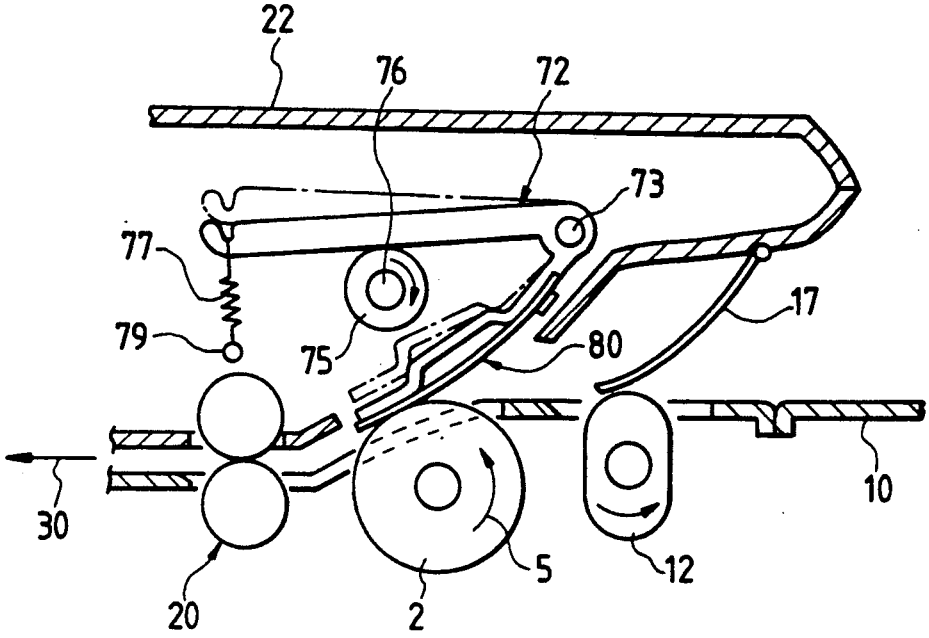
FIG. 16 is an elevational sectional view of a sheet feeding apparatus according to a second embodiment of the present invention.
Figure 17:
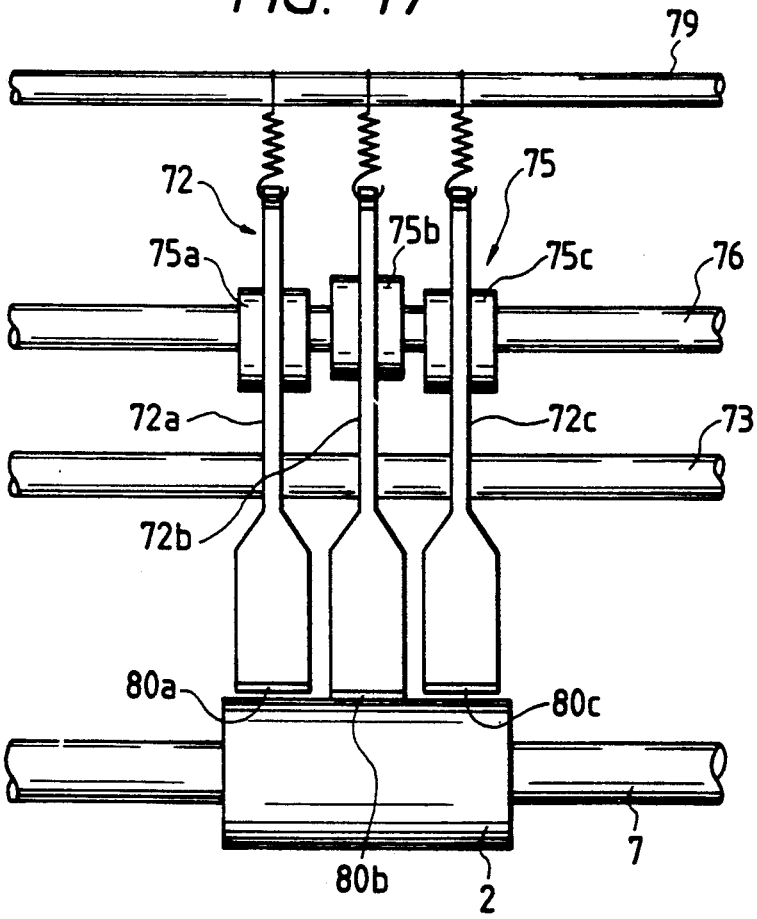
FIG. 17 is a development plan view of the sheet feeding apparatus of FIG. 16.
Figure 18:
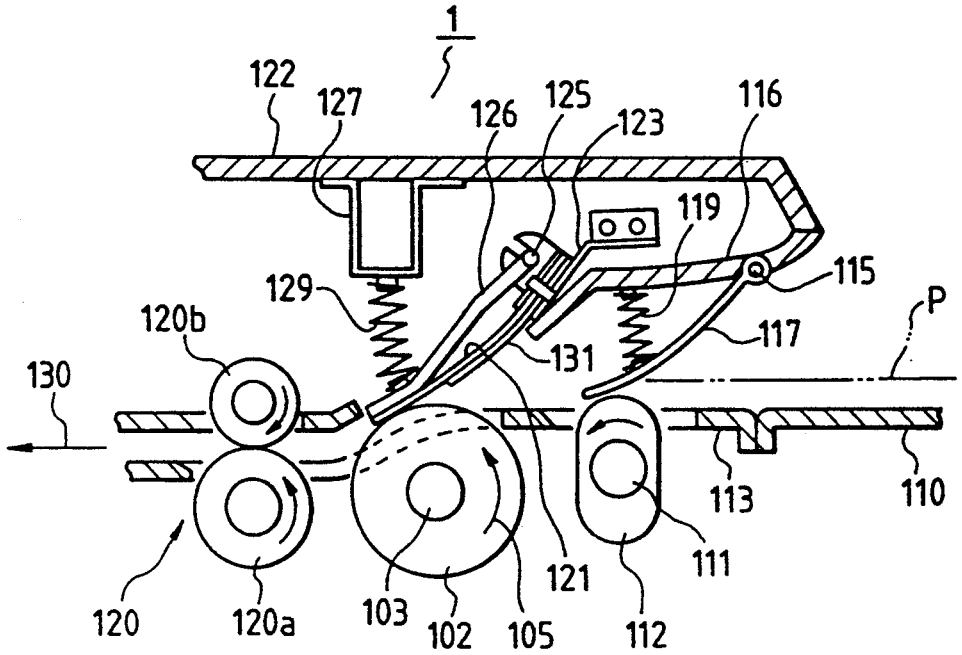
FIG. 18 PRIOR ART
FIG. 18 is an elevational sectional view of a conventional sheet feeding apparatus.

FIGS. 16 and 17 show a sheet feeding apparatus according to another embodiment of the present invention.

In this embodiment, in place of the above-mentioned rotatable separating member 6, a plurality of pressure members 72 and separating pads 80a–80c having different coefficients of friction and mounted on the respective pressure members are used.

In FIGS. 16 and 17, a plurality of L-shaped pressure members 72 pivotally mounted at there bases on a support shaft 73 are biased toward clockwise directions (FIG. 16) by means of corresponding tension springs 77 one ends of which are attached to a common shaft 79. Lower surfaces of upper arms of the pressure members 72 are urged against corresponding eccentric cams 75 (75a–75c) fixed to a cam shaft 76, respectively. Separating pads 80 (80a–80c) fixedly mounted on free ends of the corresponding pressure members 72 can be urged against or separated from a peripheral surface of the sheet supply roller 2 selectively or in combination. Also in the illustrated embodiment, the command means for urging the separating pads 80a–80c against the sheet supply roller may be the same as that of the previous embodiment, and the changing means for changing the separating pads is driven by the motor 59 connected to the cam shaft 76 so that one or more separating pads 80 (80a–80c) can be urged against or separated from the sheet supply roller 2 from one having the greatest coefficient of friction to one having the smallest coefficient of friction in order, thus permitting the supplying of the originals P having various ranges of the features.

As mentioned above, in the sheet feeding apparatus 1, the originals P are surely separated one by one. As shown in FIG. 1, an image (such as characters and the like) on the separated original P is read by an optical reading means 90, and then the original is ejected on an ejector tray (not shown) by means of a pair of ejector rollers 91, 92.

The optical reading means 90 comprises a light source 92 for emitting light to illuminate the original, and mirror 93 and lens 94 for directing the light reflected by the original to a photoelectric converter element 95 such as CCD for converting the incident light into an electric signal, the electric signal being sent to a predetermined recording system.

In the illustrated embodiments, while an example that in order to change the separating surfaces the poor separation condition is detected on the fact that the sheet supply sensor 51 does not detect within the time t was explained, the poor separation condition may be detected by detecting the load acting on the motor 33 during the original separating operation. To this end, the load acting on the motor 33 is detected by a torque sensor and the like. In this case, since the load is increased if the poor separation condition occurs, when the detected value of the torque sensor exceeds a predetermined value, it can be judged that the poor separation condition occurs, thus changing the separating surfaces.

Further, in the illustrated embodiment, in the case where the most frequently used separating surface is previously set at the initial condition, when the sheets (originals) which cannot be separated by that separating surface (and therefore, can be only by a separating surface having the greater coefficient of friction than that separating surface) are handled, the double feed of the originals will be apt to occur. Thus, a means for detecting the double feed of the originals is provided, and, if the double feed occurs, the sheet supply roller 2 is rotated reversely to feed the originals back and then the originals are supplied by the separating surface having the greatest coefficient of friction again. Since the load acting on the motor 33 is increased if the double feed condition occurs, the double feed may be determined by detecting the load acting on the motor 33 by means of a torque sensor and by judging the occurrence of the double feed when the detected value of the torque sensor exceeds a predetermined value.

What is claimed is:

1. A sheet feeding apparatus, comprising:

sheet supporting means for supporting sheets thereon;

sheet supply means for feeding out the sheets supported by said sheet supporting means;

separating means having a plurality of separating surfaces of different coefficients of friction and adapted to separate the sheets one by one cooperating with said sheet supply means by abutting against said sheet supply means;

separating surface changing means for changing said separating surface to be abutted against said sheet supply means;

detection means for detecting a poor separating condition in which the sheets are not readily separated one by one by said separating means; and control means for controlling said separating surface changing means in accordance with the detected result of said detection means to change said separating surface to be abutted against said sheet supply means.

2. A sheet feeding apparatus according to claim 1, wherein said detection means comprises a sheet detection means disposed at a downstream side of said sheet supply means and adapted to detect the sheet separated and fed out from said sheet supply means; and said control means controls said separating surface changing means to change the latter in such a manner that it judges the occurrence of the poor separating condition if said detection means does not detect the sheet until a predetermined time is elapsed after said sheet supply means starts to a supply the sheet.

3. A sheet feeding apparatus according to claim 2, wherein said control means controls said separating surface changing means to urge the separating surface of said separating means having the greatest coefficient of friction against said sheet supply means at an initial condition and to sequentially urge the separating surfaces having the smaller coefficients of friction against said sheet supply means in accordance with the poor separating condition.

4. A sheet feeding apparatus according to claim 3, wherein said control means controls said separating surface changing means whenever each sheet is separated and fed, so that the separating surface urged against said sheet supply means is returned to an initial condition.

5. A sheet feeding apparatus according to claim 1, wherein said detection means comprises a means for detecting a load of a drive source for driving said sheet supply means; and said control means controls said separating surface changing means to change the latter in such a manner that it judges the occurrence of the poor separating condition if the load of said drive source exceeds a predetermined value.

6. A sheet feeding apparatus according to claim 5, wherein said control means controls said separating surface changing means to urge the separating surface of said separating means having the greatest coefficient of friction against said sheet supply means at an initial condition and to sequentially urge the separating surfaces having the smaller coefficients of friction against said sheet supply means in accordance with the poor separating condition.

7. A sheet feeding apparatus according to claim 1, wherein said separating means comprises a rotatable roller on a peripheral surface of which the separating surfaces having different coefficients of friction are formed, and wherein the separating surface to be urged against said sheet supply means is changed by rotating said roller by means of said separating surface changing means.

8. A sheet feeding apparatus according to claim 7, wherein said separating surface changing means comprises a rotation drive means for rotating said separating means, and a position detection means for detecting the rotated position of said separating means; and wherein said control means controls the rotation of said rotation drive means on the basis of the detected result of said position detection means.

9. A sheet feeding apparatus according to claim 1, wherein said separating means comprises a plurality of arms on one ends of which the separating surfaces having different coefficients of friction are formed, respectively, and wherein the separating surface to be urged against said sheet supply means is changed by rotating either of said arms by means of said separating surface changing means.

10. A sheet feeding apparatus according to claim 9, wherein said separating surface changing means comprises a cam shaft connected to said rotation drive means, and eccentric cams disposed in correspondence to said arms and slidingly contacted by said arms in different cam phases.

11. A sheet feeding apparatus according to claim 1, wherein said separating surface changing means includes a manual operation means capable of manually changing said separating surface.

12. A sheet feeding apparatus according to claim 11, wherein one of the coefficients of friction of said separating surfaces is selected to be smaller than the coefficient of friction of the sheet.

13. A sheet feeding apparatus according to claim 1, further including a separating pressure changing means for changing a separating pressure between said sheet supply means and said separating means.

14. A sheet feeding apparatus according to claim 13, wherein said separating pressure changing means changes the separating pressure to a separating pressure in accordance with the coefficient of friction of the separating surface of said separating means to be urged against said sheet supply means.

15. A sheet feeding apparatus according to claim 1, further including a separating pressure releasing means for releasing a separating pressure between said sheet supply means and said separating means.

16. A sheet feeding apparatus according to claim 15, wherein said separating pressure releasing means releases the separating pressure when the separating surface to be urged against said sheet supply means is changed by said separating surface changing means.

17. A sheet feeding apparatus, comprising:

sheet supporting means for supporting sheets thereon;

sheet supply means for feeding out the sheets supported by said sheet supporting means;

separating means having a plurality of separating surfaces of different coefficients of friction and adapted to separate the sheets one by one cooperating with said sheet supply means by abutting against said sheet supply means;

separating surface changing means for changing said separating surface to be abutted against said sheet supply means; and separating pressure changing means for changing a separating pressure between said sheet supply means and said separating means, wherein said separating pressure changing means changes the separating pressure in accordance with the change of the separating surface of said separating means by said separating surface changing means.

18. A sheet feeding apparatus according to claim 17, wherein said separating pressure changing means comprises an elastic member for biasing said separating means toward said sheet supply means, and an adjustment means for adjusting an elastic force of said elastic means.

19. A sheet feeding apparatus according to claim 18, wherein said separating means comprises a coil spring, and wherein said adjustment means comprises an eccentric cam for changing a length of said coil spring to adjust said elastic force.

20. A sheet feeding apparatus according to claim 18, wherein said separating means comprises a coil spring, and wherein said adjustment means comprises an Archimedean cam for changing a length of said coil spring at a given rate to adjust said elastic force.

21. A sheet feeding apparatus according to claim 17, further including a separating presure releasing means for releasing a separating pressure between said sheet supply means and said separating means.

22. A sheet feeding apparatus according to claim 21, wherein said separating pressure releasing means releases the separating pressure when the separating surface to be urged against said sheet supply means is changed by said separating surface changing means.

23. A sheet feeding apparatus, comprising:

sheet supporting means for supporting sheets thereon;

sheet supply means for feeding out the sheets supported by said sheet supporting means;

separating means having a plurality of separating surfaces of different coefficients of friction and adapted to separate the sheets one by one cooperating with said sheet supply means by abutting against said sheet supply means;

separating surface changing means for changing said separating surface to be abutted against said sheet supply means; and separating pressure releasing means for releasing a separating pressure between said sheet supply means and said separating means, wherein said separating pressure releasing means releases the separating pressure when the separating surface to be urged against said sheet supply means is changed by said separating surface changing means.

24. A sheet feeding apparatus according to claim 23, wherein said separating pressure releasing means releases the separating pressure by separating said separating means from said sheet supply means by an actuator.

25. An image reading system comprising:

sheet supporting means for supporting sheets thereon;

sheet supply means for feeding out the sheets supported by said sheet supporting means;

separating means having a plurality of separating surfaces of different coefficients of friction and adapted to separate the sheets one by one between said separating means and said sheet supply means by abutting against said sheet supply means;

separating surface changing means for changing said separating surface to be abutted against said sheet supply means;

detection means for detecting a poor separating condition in which the sheets are not readily separated one by one by said separating means;

control means for controlling said separating surface changing means in accordance with the detected result of said detection means to change said separating surface to be abutted against said sheet supply means; and reading means for reading an image on the sheet separated and supplied by said sheet supply means and said separating means.

26. An image reading system according to claim 25, further including a display means for displaying a condition of the separating surface urged against said sheet supply means.

27. An image reading system according to claim 25, wherein said detection means comprises a sheet detection means disposed at a downstream side of said sheet supply means and adapted to detect the sheet separated and fed out from said sheet supply means; and said control means controls said separating surface changing means to change the latter in such a manner that it judges the occurrence of the poor separating condition if said detection means does not detect the sheet until a predetermined time is elapsed after said sheet supply means starts to supply the sheet.

28. An image reading system according to claim 27, wherein said control means controls said separating surface changing means to urge the separating surface of said separating means having the greatest coefficient of friction against said sheet supply means at an initial condition and to sequentially urge the separating surfaces having the smaller coefficients of friction against said sheet supply means in accordance with the poor separating condition.

29. An image reading system according to claim 28, wherein said control means controls said separating surface changing means whenever each sheet is separated and fed, so that the separating surface urged against said sheet supply means is returned to an initial condition.

30. An image reading system, comprising:

sheet supporting means for supporting sheets thereon;

sheet supply means for feeding out the sheets supported by said sheet supporting means;

separating means having a plurality of separating surfaces of different frictional coefficients and adapted to separate the sheets one by one cooperating with said sheet supply means with abutting against said sheet supply means;

separating surface changing means for changing said cooperating surface to be abutted against said sheet supply means;

separating pressure changing means for changing a separating pressure between said sheet supply means and said separating means, wherein said separating pressure changing means changes the separating pressure in accordance with the change of the separating surface of said separating means to be urged against said sheet supply means by said separating surface changing means; and reading means for reading an image on the sheet supplied by said sheet supply means and separated by said separating means.

31. An image reading system, comprising:

sheet supporting means for supporting sheets thereon;

sheet supply means for feeding out the sheets supported by said sheet supporting means;

separating means having a plurality of separating surfaces of different frictional coefficients and adapted to separate the sheets one by one cooperating with said sheet supply means with abutting against said sheet supply means;

separating surface changing means for changing said separating surface to be abutted against said sheet supply means;

separating pressure releasing means for releasing a separating pressure between said sheet supply means and said separating means, wherein said separating pressure releasing means releases the separating pressure when the separating surface to be urged against said sheet supply means is changed by said separating surface changing means; and a reading means for reading an image on the sheet supplied by said sheet supply means and separated by said separating means.

* * * * *

UNITED STATES PATENT AND TRADEMARK OFFICE
CERTIFICATE OF CORRECTION

PATENT NO. : 5,273,269

DATED : December 28, 1993

INVENTOR(S) : YOSHIHARU IWANAGA

It is certified that error appears in the above-identified patent and that said Letters Patent is hereby corrected as shown below:

On the Title Page, item [57]

Line 7, "and" should be deleted.

COLUMN 1

Line 23, "plate 13." should read --plate 113.--.

COLUMN 4

Line 15, "accompnaying" should read --accompanying--;
Line 22, "3 is" should read --3 which is--;
Line 47, "Mylar TM" should read --Mylar(TM)--;
Line 66, "informations" should read --information--.

COLUMN 5

Line 15, "character" should read --characters--.

COLUMN 8

Line 32, "separator" should read --separation--.

COLUMN 13

Line 59, "presure" should read --pressure--.

UNITED STATES PATENT AND TRADEMARK OFFICE

CERTIFICATE OF CORRECTION

PATENT NO. : 5,273,269

DATED : December 28, 1993

INVENTOR(S) : YOSHIHARU IWANAGA

It is certified that error appears in the above-identified patent and that said Letters Patent is hereby corrected as shown below:

COLUMN 15

Line 17, "with" (second occurrence) should read --by--.

COLUMN 16

Line 13, "with" (second occurrence) should read --by--.

Signed and Sealed this

Twelfth Day of July, 1994

*Attest:*

Bruce Lehman

BRUCE LEHMAN

*Attesting Officer*

*Commissioner of Patents and Trademarks*